United States Patent [19]

Belch

[11] Patent Number: 4,951,042

[45] Date of Patent: Aug. 21, 1990

[54] PIXEL MEMORY ARRANGEMENT FOR INFORMATION DISPLAY SYSTEM

[75] Inventor: Francis R. Belch, Sale, England

[73] Assignee: Ferranti PLC, Cheshire, England

[21] Appl. No.: 141,001

[22] Filed: Jan. 5, 1988

[30] Foreign Application Priority Data

Jan. 13, 1987 [GB] United Kingdom ..... 87.00731

[51] Int. Cl.[5] ..... G09G 1/02

[52] U.S. Cl. ..... 340/799; 340/798

[58] Field of Search ..... 340/799, 798, 750, 801

[56] References Cited

U.S. PATENT DOCUMENTS

| | | | |
|---|---|---|---|
| 4,092,728 | 5/1978 | Baltzer | 340/799 |
| 4,742,474 | 5/1988 | Knierim | 340/799 |
| 4,745,407 | 5/1988 | Costello | 340/799 |
| 4,766,431 | 8/1988 | Kobayashi et al. | 340/799 |

*Primary Examiner*—Jeffery A. Brier

*Attorney, Agent, or Firm*—Kerkam, Stowell, Kondracki & Clarke

[57] ABSTRACT

A pixel data memory is provided for use with an information display system having a raster scan screen divided into a plurality of pixels each of which represents a separate area of the screen. The memory comprises a multiple-bit memory plane (13) capable of providing a plurality of separate bit locations each of which may correspond to a separate display pixel and arranged to store pixel data in the form of a plurality of multiple-bit words. The memory plane (13) comprises a number of memory chips each capable of storing a separate bit of each of the multiple-bit words. An address generator (10) is operable to generate the addresses of required individual bit locations in the memory plane. A number of separate control circuits (14) are provided, equal to the number of bits in each word. Each control circuit (14) is associated with a separate memory chip and is responsive to a generated address defining a bit location on that chip to access the pixel data identified by the bit at that location. The control circuits are operable in an asynchronous manner so as to allow pixel data to be written into a read out from a number of bit locations simultaneously.

2 Claims, 7 Drawing Sheets

| | | | | | | | | | | | | | | | | | | | |
|---|---|---|---|---|---|---|---|---|---|---|---|---|---|---|---|---|---|---|---|
| Px | 1 | 2 | 3 | 4 | 5 | . . . . | 15 | 16 | 17 | 18 | 19 | 20 | 1 | 2 | 3 | 4 | . . |
| LN1 | 1 | 2 | 3 | 4 | 5 | . . . . | 15 | 16 | 17 | 18 | 19 | 20 | 1 | 2 | 3 | 4 | . . |
| LN2 | 1 | 2 | 3 | 4 | 5 | . . . . | 15 | 16 | 17 | 18 | 19 | 20 | 1 | 2 | 3 | 4 | . . |
| LN3 | 1 | 2 | 3 | 4 | 5 | . . . . | 15 | 16 | 17 | 18 | 19 | 20 | 1 | 2 | 3 | 4 | . . |
| LN4 | 1 | 2 | 3 | 4 | 5 | . . . . | 15 | 16 | 17 | 18 | 19 | 20 | 1 | 2 | 3 | 4 | . . |
| LN5 | 1 | 2 | 3 | 4 | 5 | . . . . | 15 | 16 | 17 | 18 | 19 | 20 | 1 | 2 | 3 | 4 | . . |
| LN6 | 1 | 2 | 3 | 4 | 5 | . . . . | 15 | 16 | 17 | 18 | 19 | 20 | 1 | 2 | 3 | 4 | . . |
| LN7 | 1 | 2 | 3 | 4 | 5 | . . . . | 15 | 16 | 17 | 18 | 19 | 20 | 1 | 2 | 3 | 4 | . . |

Fig. 5
PRIOR ART

| | | | | | | | | | | | | | | | | | | | |
|---|---|---|---|---|---|---|---|---|---|---|---|---|---|---|---|---|---|---|---|
| Px | 1 | 2 | 3 | 4 | 5 | . . . . | 15 | 16 | 17 | 18 | 19 | 20 | 1 | 2 | 3 | . . |
| LN1 | 1 | 2 | 3 | 4 | 5 | . . . . | 15 | 16 | 17 | 18 | 19 | 20 | 1 | 2 | 3 | . . |
| LN2 | 5 | 6 | 7 | 8 | 9 | . . . . | 19 | 20 | 1 | 2 | 3 | 4 | 5 | 6 | 7 | . . |
| LN3 | 9 | 10 | 11 | 12 | 13 | . . . . | 3 | 4 | 5 | 6 | 7 | 8 | 9 | 10 | 11 | . . |
| LN4 | 13 | 14 | 15 | 16 | 17 | . . . . | 7 | 8 | 9 | 10 | 11 | 12 | 13 | 14 | 15 | . . |
| LN5 | 17 | 18 | 19 | 20 | 1 | . . . . | 11 | 12 | 13 | 14 | 15 | 16 | 17 | 18 | 19 | . . |
| LN6 | 1 | 2 | 3 | 4 | 5 | . . . . | 15 | 16 | 17 | 18 | 19 | 20 | 1 | 2 | 3 | . . |

Fig. 6

Fig.7

| Px | 1 | 2 | 3 | 4 | 5 | . . . . . | 15 | 16 | 17 | 18 | 19 | 20 | 1 | 2 | 3 | . . |
|---|---|---|---|---|---|---|---|---|---|---|---|---|---|---|---|---|
| LN1 | 1 | 2 | 3 | 4 | 5 | . . . . . | 15 | 16 | 17 | 18 | 19 | 20 | 1 | 2 | 3 | . . |
| LN2 | 5 | 6 | 7 | 8 | 9 | . . . . . | 19 | 20 | 1 | 2 | 3 | 4 | 5 | 6 | 7 | . . |
| LN3 | 9 | 10 | 11 | 12 | 13 | . . . . . | 3 | 4 | 5 | 6 | 7 | 8 | 9 | 10 | 11 | . . |
| LN4 | 13 | 14 | 15 | 16 | 17 | . . . . . | 7 | 8 | 9 | 10 | 11 | 12 | 13 | 14 | 15 | . . |
| LN5 | 17 | 18 | 19 | 20 | 1 | . . . . . | 11 | 12 | 13 | 14 | 15 | 16 | 17 | 18 | 19 | . . |
| LN6 | 1 | 2 | 3 | 4 | 5 | . . . . . | 15 | 16 | 17 | 18 | 19 | 20 | 1 | 2 | 3 | . . |

71

72

PIXEL MEMORY ARRANGEMENT FOR INFORMATION DISPLAY SYSTEM

Information display systems are known in which a store or memory contains a binary digit, or bit, of information for every displayable point, or pixel, on a display screen. Setting the bit to one or other of two states causes the point to be displayed or not displayed. It is common for each pixel to be defined by a group of bits, rather than by a single bit, so that other parameters such as brightness, colour and the like may also be defined. In such cases the memory is divided up into what are known as planes, conceptually parallel to one another and each containing one bit per pixel. The number of planes required is thus equal to the number of bits used to define each pixel. Display systems having such single or multiple plane memories are usually referred to as bit mapped display systems.

Bits of information are usually grouped into words, the length of which depends upon the characteristics of the particular system. Word lengths of 16, 20 or 32 bits are common but other word lengths are used.

In a bit mapped raster scan display system each pixel plane is scanned in order to generate the raster scan line pixels for every visible point on the screen. This has to be repeated at a rate which generates a comfortably viewable picture. Each plane is provided with similar logic which enables a central processor to write bits of data into that plane so as to change the picture on the display screen. Similarly, each plane has similar logic which is used to read bits of data from that plane prior to combining the data to provide the picture to be displayed. With contemporary memory devices such as video random access memories these mechanisms may be substantially separate.

As already stated, bits are arranged into words which are themselves grouped into lines. Lines are usually horizontal on the screen and fill the screen from top to bottom. By tradition, memories have been word organised with a separate memory chip storing the same bit of each word. Once a chip is cycled by a central processor to read or write a particular bit of one word then the cycle must be completed before the same bit of another word may be read. Such an arrangement means that, if a vector is to be drawn on the screen, the cycle time for writing each bit of pixel data into the memory is always the same, being the cycle time of a memory chip.

Clearly this imposes limitations on the speed at which stored data may be changed in the display memory hence it also limits the speed of change of the display.

The references to write into the memory cover the alternative mechanisms of directly over-writing on to whatever may be already stored, or the read-modify-write cycle which is frequently used. The present invention is mainly concerned with the writing of new data into the pixel memory rather than with the retrieval of data for subsequent display.

It is an object of the present invention to provide a pixel memory for an information display system in which speed of storage of pixel data may be increased.

According to the present invention there is provided a pixel data memory for use with an information display system having a raster scan display screen divided into a plurality of pixels each of which represents a separate area of the screen, the memory including a multiple-bit memory plane capable of providing a plurality of separate bit locations each of which may correspond to a separate display pixel and arranged to store pixel data in the form of a plurality of multiple-bit words, the memory plane comprising a number of memory chips each capable of storing a separate bit of each of said multiple-bit words; address generating means operable to generate the addresses of required individual bit locations in the memory plane; and a number of separate control circuits equal to the number of bits in each word, associated one with each memory chip and each responsive to a generated address defining a bit location on that memory chip to access the pixel data identified by the bit at that location, and operable in an asynchronous manner so as to allow pixel data to be written into or read out from a number of bit locations independently.

The expression "written into" is used to include the alternative operations of over-writing existing data or performing a read-modify-write sequence.

The invention will now be described with reference to the accompanying drawings, in which:

FIG. 1 is a schematic block diagram showing the main elements of a first feature of the invention;

FIGS. 2, 2*a*, and 2*b* are schematic diagrams illustrating the features of FIG. 1;

FIG. 3. is a logic diagram of part of the diagram of FIG. 2;

FIG. 5 illustrates the organisation of part of a conventional memory plane;

FIG. 6 illustrates the organisation of part of a memory plane according to a second feature of the invention;

FIG. 7 illustrates the use of the memory plane organisation of FIG. 6;

Figure 1:
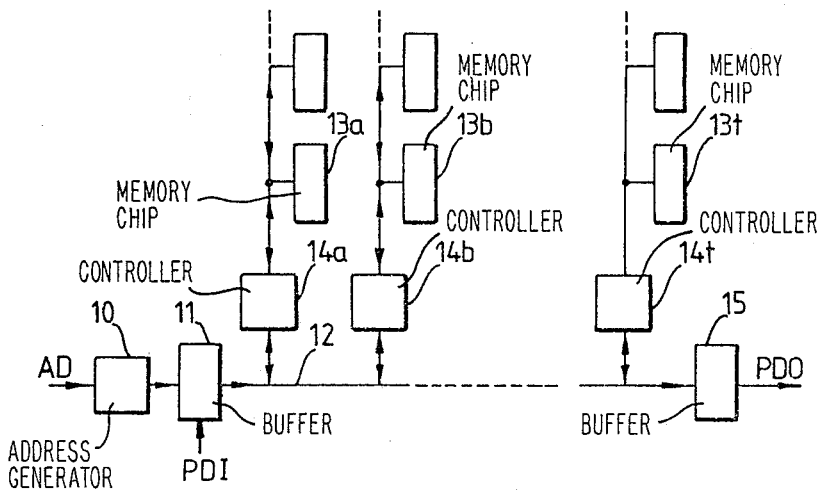

Referring now to FIG. 1, the basic elements of one half of a double-buffered pixel data memory are shown in schematic block form. An address generator 10 has an input AD from external logic and applies outputs through an input buffer 11 onto a highway 12. Twenty groups of memory chips (13*a*–13*t*) are provided, of which only three are shown, and each group is connected to the data highway 12 through a separate controller (14*a*–14*t*), again only three being shown. The data highway 12 is connected through an output buffer 15 to the display generating circuitry (not shown).

In its simplest form the address generator 10 is a look-up table to which are applied the screen x and y coordinates of pixels for which data is to be written into or read out of the memory. The output of the look-up table in response to any pair of pixel coordinates is a bit address of 5 bits, which identifies one particular controller 14 out of 20, and a word address of, say, 16 bits which identifies a particular bit location in each of the planes controlled by that controller. Once the bit location has been identified the appropriate action may be taken with regard to data to be stored at that bit location. Pixel data to be written into a set of memory planes is applied through an input PDI to the input buffer 11 and on to the highway 12. Similarly, pixel data read out from a set of memory planes passes along the highway 12 to the output buffer 15, which it leaves on an output PDO to external display control circuitry.

In operation, a sequence of pixel address coordinates is applied to the AD input of the address generator, which responds by producing a sequence of bit and word addresses which are applied to the highway 12. Each controller 14 recognises, by the bit address, those word addresses relating to locations in its associated memory chips 13. Each set of memory chips is cycled individually by its controller, individual cycles being out of phase with one another by multiples of the pixel clock period.

The above process occurs regardless of whether the controller is required to write pixel data into memory planes or to read such data out. In either case the controller requires additional, conventional, circuitry, to enable this to be done. The techniques used will not be described in detail since they are standard.

It will be appreciated that the single highway 12 shown in FIG. 1 is a simplification. In practice the address and data highways will be separate, with a separate data highway for each memory plane.

Figure 2:
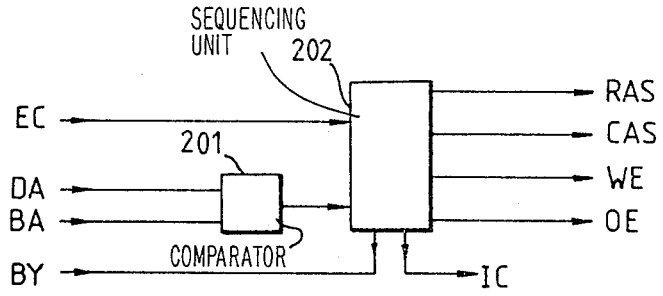

A brief description of some of the details of the memory chip controller will now be given, with reference to FIGS. 2, 2*a*, and 2*b*. These Figures show schematic block diagrams;

FIG. 2 is concerned with generating control signals which determine the mode of operation of the memory controller. A bit address comparator 201 has applied to it the 5-bit addresses BA applied to the highway 12 of FIG. 1. The comparator has a designated address DA, which is in practice probably defined by wiring permanent high and low states to a series of physical connections. The output of the comparator 201 is applied to a control and sequencing unit 202. This is able to produce, depending upon the input signals, one of the four signals shown. These are "row address strobe" RAS, "column address strobe" CAS, "write enable" WE and "output enable" OE. In addition, if the control and sequencing unit 202 is already in use when it receives its own bit address from the highway then it generates a "busy" signal BY to stop further data being addressed to it.

Figure 2A:
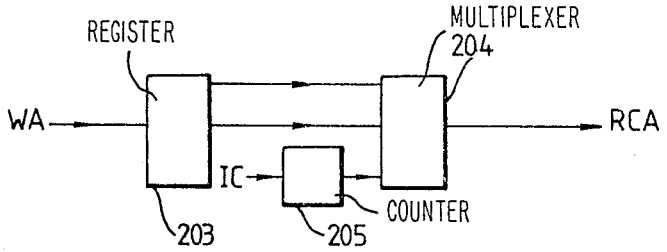

FIG. 2*a* comprises a word address register 203 to which is applied the sequence of word addresses WA appearing on the data highway. The output of the word address register 203 is connected to a row and column address multiplexer 204 which produces an output RCA which represents the row and column addresses of bit locations in the memory. A refresh counter 205 is provided which is used to drive the row and column address multiplexer in certain circumstances.

Figure 2B:
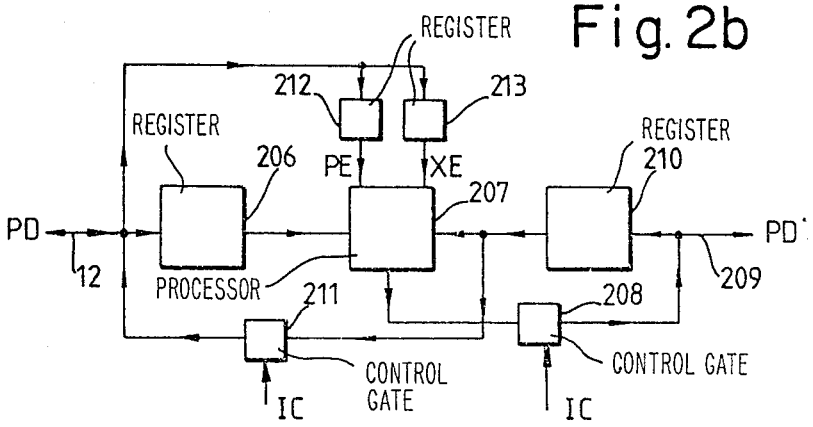

FIG. 2*b* processes the pixel data to be applied to, or read out of, the memory chip. A bidirectional input highway carries pixel data PD to a pixel write register 206. The output from this register is applied to a pixel processor 207. From the processor an output passes through a control gate 208 to a bidirection data highway 209 to the memory chip. Pixel data from the memory chip is applied along data highway 209 to a pixel read register 210 and from there both to the pixel processor 207 and through a control gate 211 to the data highway 12.

The pixel processor 207 is controlled by two pixel function registers 212 and 213. Each of these may be loaded over the data highway 12 as determined by the external control signals EC applied to the control and sequencing unit 202. Register 212 contains plane enable bits (PE) to determine whether pixel data may be loaded into each memory plane or not, whilst register 213 contains exclusive-OR enable bits (XE) which determine whether an exclusive-OR operation should be performed between pixel data applied to and read from the same bit locations in the memory.

Figure 3:
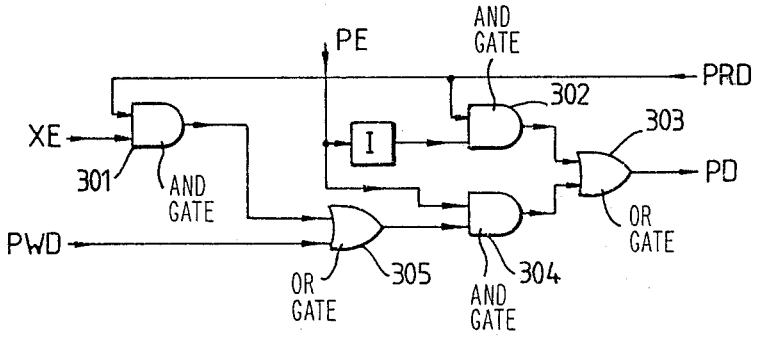

A further degree of detail is shown in FIG. 3, which shows a logic diagram of the pixel Processor 207 of FIG. 2. FIG. 3 shows the processor for a one-bit data path. The detail is therefore repeated for each separate data path. The pixel processor is an arrangement of gates having four inputs and one output. Pixel write data (PWD) from the pixel write register 206, and pixel read data (PRD) from the pixel read register 210 make up the two data inputs to the processor, whilst control signals PE and XE are applied from the pixel function registers 212 and 213 respectively as shown also in FIG. 2.

The operation of the memory controller shown in FIGS. 2 and 3 will now be briefly described.

The external control signals EC applied to the control and sequencing unit 202 of FIG. 2 may be in the form of one of a number of binary codes. By way of example, the code 000 may be applied when writing pixel data into the memory, whilst code 001 is applied when pixel data is to be read from the memory for subsequent display. Code 010 may be used to operate the refresh counter 205 whilst codes 011 and 100 are provided to allow for the loading of the registers 212 and 213 respectively. These external codes EC are converted by the control and sequencing unit into internal signals produced at the appropriate time and applied, for example, to the refresh counter 205 or to registers 212 and 213.

As already stated, the designated address input DA to comparator 201 is compared with each 5-bit address applied to the data highway 12 by the address generator 10 of FIG. 1. When the designated address also appears on the highway the output of the comparator 201 activates the control and sequencing unit 202. If the unit 202 is already operating then it sends a "busy" signal BY back along the highway 12 to stop the generation of further pixel data for that controller until it is free.

If the controller 202 is not in operation then the word address on the highway 12 is written into the word address register 203. At the same time if the external code EC indicates that pixel data or the highway is to be written into the pixel data memory then the pixel data bits are written into the pixel write register 206. The controller 202 also produces the output signals necessary to allow such an operation to take place, be it a read-modify-write cycle or a write cycle.

The word address in the register 203 is converted by the row and column address multiplexer 204 into the specific row and column addresses of the bit locations in each of the memory chips controlled by the controller 202.

Several alternative situations may exist when pixel data is to be written into the pixel data memory. Considering the logic diagram of FIG. 3 representing a single data bit path, if the pixel plane enable bit PE is not set then the contents of the plane cannot be changed. Each bit read from the memory passes through the pixel read register 210 and is applied to AND gate 301 and to AND gate 302. Since the PE signal is absent the pixel read bit passes through AND gate 302 and OR gate 303 and becomes the pixel data bit PD to be written back into the memory. Control gate 208 (FIG. 2) allows this bit to pass over the highway 209 to the memory where it is written back into the same bit location from which it was read.

If the plane enable bit PE is set, then AND gate 304 is enabled. An incoming pixel write data bit PWD passes through exclusive-OR gate 305 unchanged, assuming the absence of an XE bit from the register 213 of FIG. 2, and through OR gate 303 to be written into the memory. In this case the new data bit replaces that read out from the memory.

The final situation which may exist is that both the PE and XE bits from registers 212 and 213 of FIG. 2 are present. The data bit PRD read out from a bit location in the memory is "exclusive OR'd" with the new data bit PWD in gate 305 and the result passes through OR gate 303 to the memory.

When pixel data is to be read out of the memory for display, a sequence of successive pixel addresses is applied to the memory from the multiplexer 204. The successive pixel data bits read out pass through the pixel read register 210 and through control gate 211 to the data highway 12.

As has already been stated, the advantage of the invention described above lies in the use of a bit organised memory as contrasted with the word-organised memory used previously. This enables greater speeds of operation to be used in almost all situations.

Figure 4:
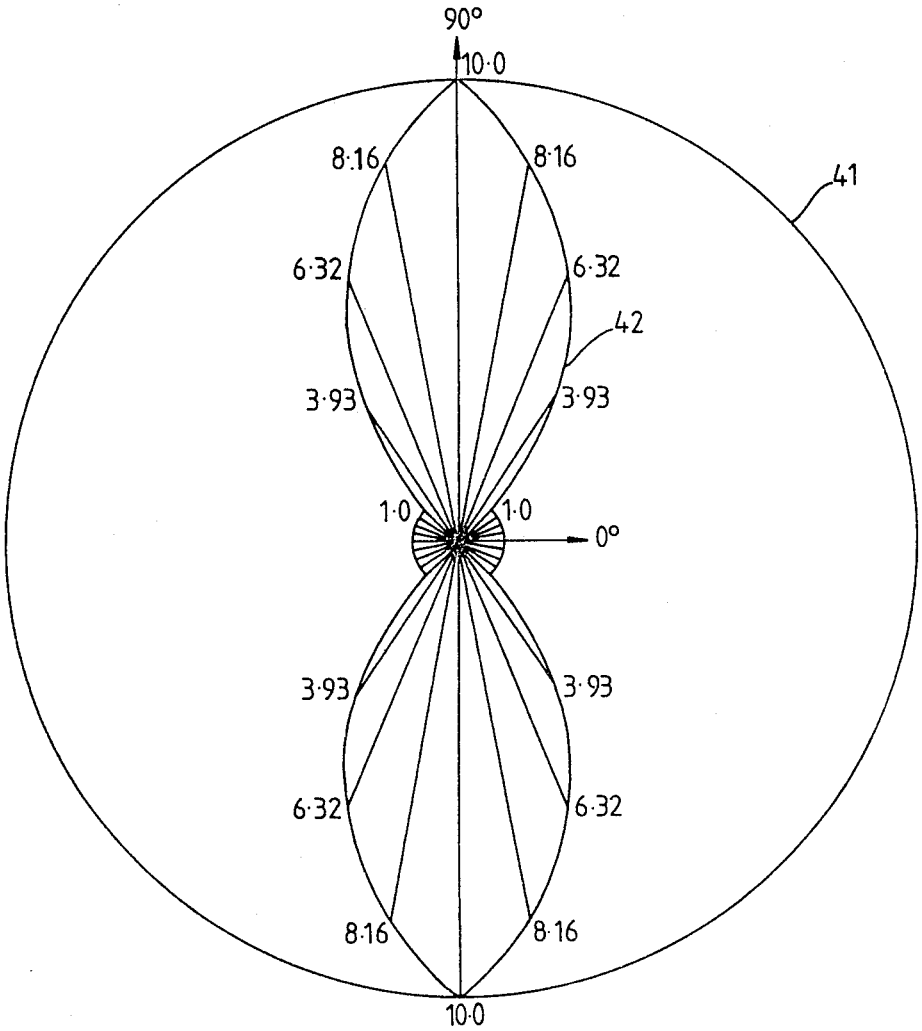
FIG. 4 illustrates the benefits of the feature of FIGS. 1 to 3.

FIG. 4 illustrates the benefits, obtained by using a bit-organised memory when writing pixel data into the memory. The figure shows two polar plots of pixel write time (r) against vector direction ($\theta$) and represents the average time taken to write into the memory the pixel data relating to one pixel only of a continuous straight line extending across the display screen in the direction $\theta$. It has been assumed that a memory chip has a cycle time of 10 pixel clock periods, which in present-day terms means about 400 nanoseconds.

The circle 41 is a plot of pixel write time versus vector direction for a word-organised pixel data memory using 20-bit words. Since only a single controller is used any memory chip has to be allowed to complete its cycle before the next one can be addressed. The average pixel write time is therefore always 10 pixel clock periods, regardless of the vector direction.

In the case of the bit-organised memory of the present invention, however, the situation is different. In the case of vectors drawn at angles up to 45°, for example, each bit of pixel data will be stored in a different memory chip, and all the chips may be cycled asynchronously at one pixel clock period intervals. Hence the average time for a line pixel will be one pixel clock period. The other extreme situation is that of a vertical line, where each bit of pixel data is contained in the same memory chip, which therefore has to complete its cycle each time before the next pixel is written to write the necessary data into the memory. The average time per pixel is thus one memory cycle time or 10 pixel clock periods. For vector angles between 45° and 90° the average time varies as shown in the drawing and the complete FIG. 42 covering the full 360° is symmetrical about horizontal and vertical axes. It will be seen from FIG. 4 that the invention so far described provides for considerable increases in writing speed for vectors drawn in most directions.

The memory arrangement shown in FIG. 1 is, as already stated, one-half of a double-buffered system using dynamic random access memory chips. Such an arrangement cannot be written into and read from simultaneously, and hence such a double-buffered system uses two complete memories. One may be providing screen support whilst the contents of the other are being changed. The use of the video random access memory chip permits the simultaneous reading and writing operations and requires separate output data highways rather than the common input-output highway shown in Figure. Other variations to pixel memories are well known.

Whilst the invention so far described provides considerable increases in operating speed for lines drawn at angles up to 45° and some increase for larger angles, there is room for further improvement, particularly for lines drawn at angles approaching 90°. Such improvements are possible, as will be described below.

FIG. 5 illustrates the organisation of part of one plane of a conventional pixel memory, based on the use of 20-bit words. There will therefore be 20 memory devices in which the pixel data is stored. The drawing shows a representation of part of a display screen, with each line within the block representating a line on the screen. The numbers against each block indicate every line, whilst the numbers in the block indicate the memory device within which pixel data for each pixel in each line is stored. Thus for the first line on the display each bit of data for pixels 1 to 20 resides within memory devices 1 to 20 respectively. The same applies for each line of the display screen. Thus memory device 1, for example, will contain the pixel data bit for every pixel 1, memory device 2 will contain the pixel data bit for every pixel 2, and so on. Suppose that a vertical line is to be written. Such a line occupies a column of bits, each bit having the same number, that number indicating the bits'position within a memory word. But from the architecture shown in FIG. 5 all bits having the same position number reside within the same memory device, just occupying different addresses within that device. This means that in order to write a vertical line a memory write cycle must take place for every individual pixel and hence that the write time for a single pixel is equal to the memory device write cycle time.

FIG. 6 illustrates the principle of a pixel memory organisation which permits further improvements in speed to be achieved. As will be seen from FIG. 6 the number of the memory bit corresponding to each pixel is shifted cyclically by four bits to the left within each word and confined to that word each successive line of the display. On line 1 of the display therefore, pixel data for each of pixels 1 to 20 is stored in the corresponding memory device. In line 2, however, pixel data for pixels 1 to 20 is stored in memory devices 5 to 20 and 1 to 4 respectively. For line 3, the pixel data for the 20 pixels is stored in memory devices 9 to 20 and 1 to 8 respectively. This shift is repeated in each line until for line 6 there is again direct correspondence between the pixel number and the memory device number.

Suppose again with the revised architecture that a vertical line is to be written. With the previous architecture all bits along the line would have resided within the same memory device, but now it is seen from FIG. 6 that with the new architecture a continuous run of up to five vertical pixels can be written such that all pixels reside within different memory devices. Because of this up to five vertical pixels can be written within a single memory write cycle time. The writing speed for long vertical lines therefore tends towards the write cycle time for the type of memory device used divided by five. This represents a factor of five speed improvement in the possible writing rate for vertical lines.

It can be shown that an improvement is achieved for other line directions too.

FIG. 7 is a repeat of FIG. 6 but including two patches 71 and 72 each five pixels high and four pixels wide. What is notable is that for these and any other arbitrary patch of these dimensions no memory device number appears twice, and every memory device appears just once. Because of this a constant speed improvement factor of four is obtained for line directions from the vertical up to 45 degrees and from four to five for line directions from 45 up to 90 degrees. This is because for these line directions successive line pixels do not reside within the same memory device.

Figure 8:
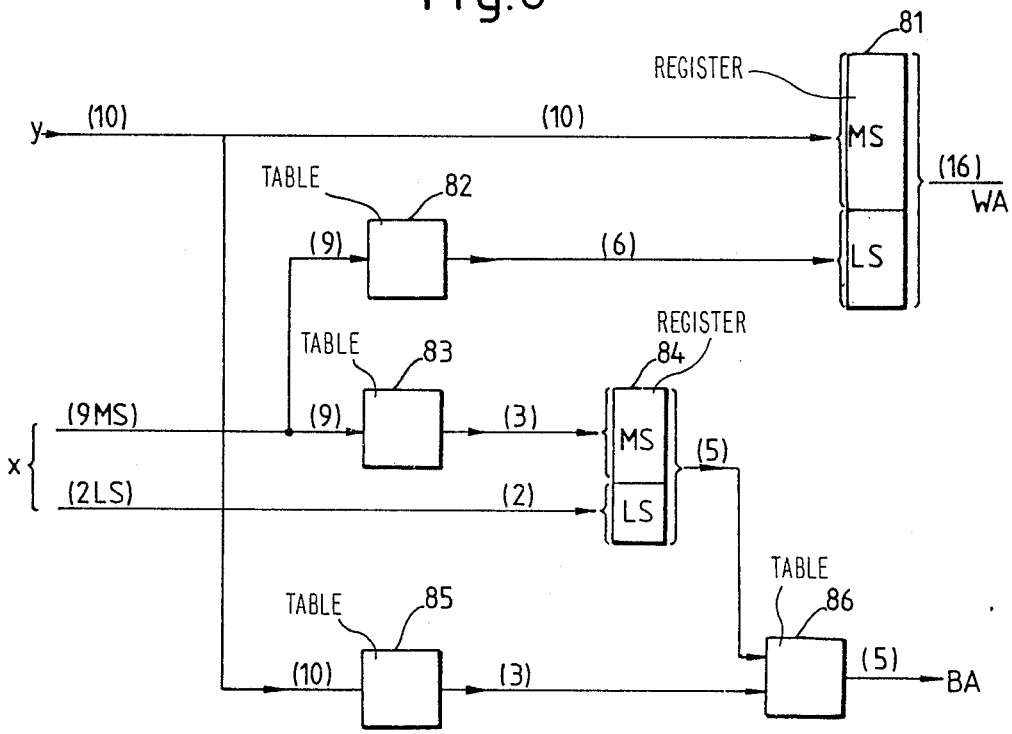
FIG. 8 is a schematic block diagram of a write address generator for use with the second feature.

So far as the apparatus necessary to operate in the manner described is concerned, the main difference lies with the write address generator 10 shown in FIG. 1. In the embodiment described with reference to FIGS. 1 to 4, the address generator was, in its simplest form, a look-up table to which were applied the screen x and y coordinates of a pixel for which data was to be stored and which delivered a bit address and a word address for application to the memory chips. With the present embodiment, whilst the write address generator performs the same function, it is required to take account of the shift introduced into each successive line. FIG. 8 is a block diagram of a suitable write address generator for this purpose. The numbers in brackets indicate the number of parallel bits making up an input or output. As FIG. 8 shows, the input to the address generator consists of the screen x and y addresses. If we consider a screen comprising 1280×1024 pixels organised into 20-bit words, then the x address will consist of 11 bits whilst the y address will consist of 10 bits. As will be seen from FIG. 8, the 10 bits of the y address of a pixel form the ten most significant (MS) bits of the memory word address, which is held in a 16-bit register represented at 81 in FIG. 8. In order to provide the 6 least significant (LS) bits of the word address 81, the 9 most significant bits of the x pixel address are passed through a divide-by-20 look-up table 82 and register 81.

The nine most significant bits of the eleven-bit x address is passed to a look-up table 83 which performs a divide-by-5 operation and provide a 3-bit output representing the remainder obtained from the operation. These three bits provide the three most significant bits of a five bit number stored in a register 84, the other two bits being the two least significant bits of the x address. The contents of register 84 represent the 5-bit bit address without taking account of successive line shifts. The effect of line shift is provided by passing the 10-bit y address to a look-up table 85 which performs a divide-by-5 operation and produces a 3-bit remainder from that operation. These three bits indicate which line of a 5-line group is involved. The five bits from register 84 and the three bits from look-up table 85 form an 8-bit word which is applied to a look-up table 86 which translates the 8 bits applied into a five-bit bit address for application to the memory chips along with the 16-bit word address.

Figure 9:
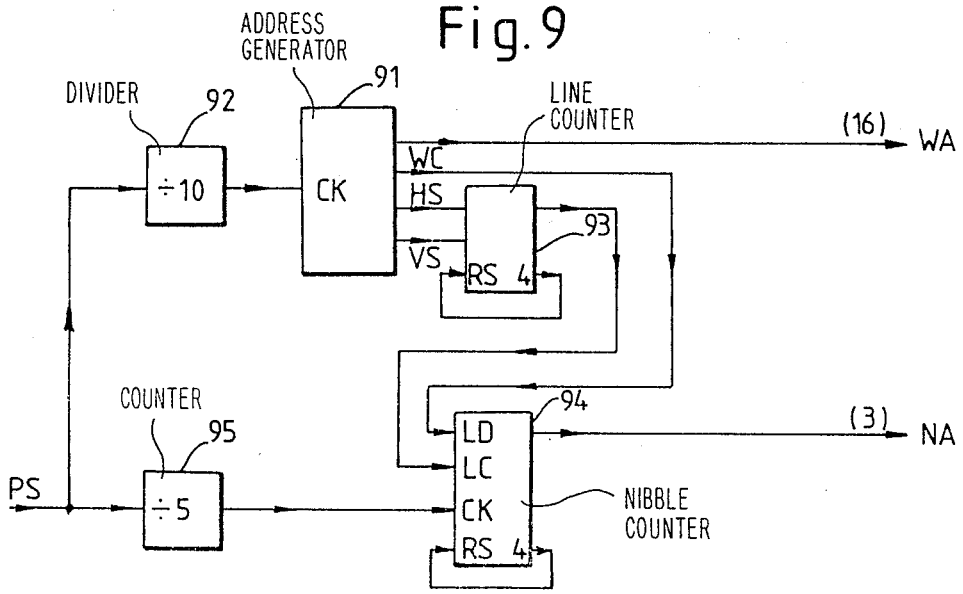
FIG. 9 is a schematic diagram of a read address generator according to the second feature.

The reading of stored data from the pixel memory for application to a display is a question of applying a continuous sequence of addresses so that the appropriate pixel data is read out from the memory for subsequent serialisation. In practice, word and four-bit nibble addresses need to be generated. As with the write address generator of FIG. 8, the read address generator has to take account of nibble shifts or successive lines. FIG. 9 shows one arrangement of a read address generator which provides word and bit addresses for use with 20-bit words.

The central part of the read address generator is a commercially-available component designed for the purpose, such as the 7220, which generates a sequence of successive word addresses corresponding to the "dimensions" of the pixel memory area to be scanned. When provided with an appropriate clock input, the 7220 delivers outputs giving (a) 16-bit word address WA, (b) an output WC at the beginning of each word, (c) a synchronising signal HS at the end or beginning of each line, and (d) a synchronising signal VS at the end or beginning of each frame. FIG. 9 shows the 7220 word address generator 91 having a clock input at twice the word clock frequency, produced by dividing the pixel clock PC by 10 in divider 92. The word address output WA is obtained directly from the word address generator 91. The HS output of the word address generator is used to clock a line counter 93 which counts from 0 to 4 , the '4' output being used to clear the counter to zero. The VS output from 91 sets the line counter 93 to zero at the end of each frame.

The 3-bit nibble address NA is obtained from a nibble counter 94, counting from 0 to 4 and clocked by the pixel clock divided by 5 by counter 95. The counter 94 is reset each time the "4" output is obtained. To take account of the line shift, the LC output of line counter 93 is loaded into nibble counter 94 at the beginning of each successive word, loading being activated by each appearance of the "word count" WC output of the word address generator. Thus during line 0 the nibble counter must start at 0 at the beginning of each word time, during line 1 the counter must start at 1, during line 2 it must start at 2 and so.

Figure 10:
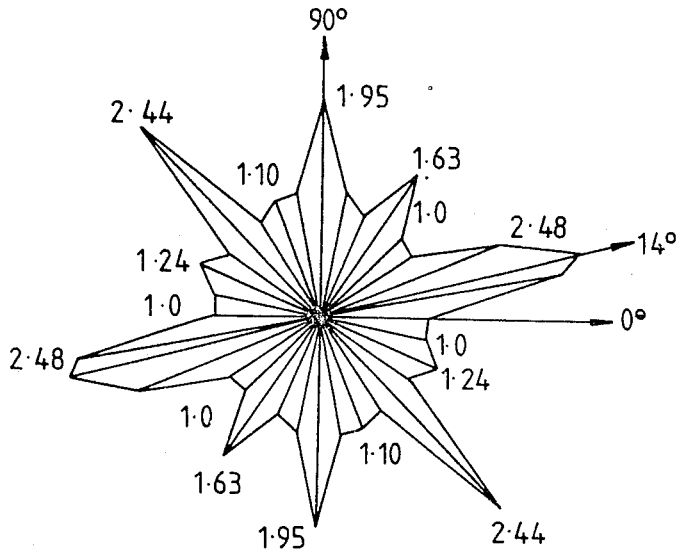
FIG. 10 illustrates the benefit of the second feature.

FIG. 4 showed the improvements possible with the use of a bit-organised memory arrangement, comparing it with the previously-used word organised memory. FIG. 10 shows, to a larger scale, the further improvements which may be attained by using in addition the shifted store addressing as described above. It will be seen from FIG. 10 that the worst case is represented by a line drawn at an angle of 14°, where the average pixel write time is 2.48 pixel clock periods. At all other angles the average pixel write time is less than this. The combination of bit organised memory and shifted store addressing thus provides a very considerable increase in writing speed over the previously-known techniques.

I claim:

1. A pixel data memory for use with an information display system having a raster scan display screen divided into a plurality of pixels each of which represents a separate area of the screen, the memory including a multiple-bit memory plane capable of providing a plurality of separate bit locations each of which may correspond to a separate display pixel and arranged to store pixel data in the form of a plurality of multiple-bit words, the memory plane comprising a number of memory chips equal to the number of bits in a word and each capable of storing a separate bit of each of said multiple-bit words which may represent pixel data on each line of the raster scan of the display, the stored bit being the same bit in each word representing pixel data on any one line of the raster scan and being stored in the memory plane in a location which is displaced cyclically within the word by n bits relative to the same bit in each word representing pixel data on an immediately preceding line of the raster scan, where n is an integer; address generating means operable to generate the addresses of required individual bit locations in the memory plane; and a number of separate control circuits equal to the number of bits in each word, associated one with each memory chip and each responsive to a generated address defining a bit location on that memory chip to access the pixel data identified by the bit at that location, and operable in an asynchronous manner so as to allow pixel data to be written into or read out from a number of bit locations independently.

2. A memory as claimed in claim 1 which includes further multiple-bit memory planes in which pixel data may be stored in the same arrangement as in said memory plane, corresponding bits in each memory plane together defining the parameters of a single display pixel.

* * * * *